United States Patent [19]

Hubbard et al.

[11] 4,283,882

[45] Aug. 18, 1981

[54] SAFETY FLUSH BOLT ENTRANCE DOOR SYSTEM

[75] Inventors: S. Eugene Hubbard, Niles; Richard A. Meisterheim, Dowagiac, both of Mich.; Ernest B. Symon, South Bend, Ind.

[73] Assignee: Kawneer Company, Inc., Niles, Mich.

[21] Appl. No.: 85,606

[22] Filed: Oct. 17, 1979

[51] Int. Cl.[3] ..... E05C 15/02; E05B 65/10

[52] U.S. Cl. ..... 49/141; 49/366; 49/395; 292/18; 292/21

[58] Field of Search ..... 49/141, 395, 366; 292/18, 21, 92, DIG. 21

[56] References Cited

U.S. PATENT DOCUMENTS

| | | | |
|---|---|---|---|
| 1,137,863 | 5/1915 | Keough | 292/18 |
| 2,887,336 | 5/1959 | Meyer | 292/21 |
| 3,083,560 | 4/1963 | Scott | 49/395 X |
| 3,124,378 | 3/1964 | Jackson | 292/21 X |
| 3,214,947 | 11/1965 | Wikkerink | 292/92 X |
| 3,805,451 | 4/1974 | Miller | 49/141 X |

*Primary Examiner*—Philip C. Kannan

*Attorney, Agent, or Firm*—Mason, Kolehmainen, Rathburn & Wyss

[57] ABSTRACT

A safety flush bolt entrance door system includes a pair of doors mounted in an entrance frame for outward opening with each door pivotally supported for individual opening and closing movement. A normally active door is provided with a locking mechanism adapted to engage an opposite, normally inactive, door for securing the doors together. One or more flush bolt mechanism(s) is mounted on the normally inactive door for locking the door with the door frame whenever the locking mechanism on the active door is engaged with the inactive door. A control mechanism is mounted on the inactive door and interconnected with the flush bolt mechanism(s) so that whenever the active door is unlocked, the flush bolt mechanism(s) is releasable in response to an opening force applied against the inactive door.

41 Claims, 20 Drawing Figures

SAFETY FLUSH BOLT ENTRANCE DOOR SYSTEM

BACKGROUND OF THE INVENTION

1. Field of the Invention

The present invention relates to safety flush bolt entrance door systems and more particularly to an entrance door system including a pair of outwardly opening hinged doors mounted in a door frame and provided with a single locking mechanism on a normally active door engageable with a normally inactive door and operably connected through a control mechanism for controlling one or more flush bolt mechanisms on the inactive door for locking the inactive door to the door frame whenever the locking mechanism on the active door is lockingly engaged with the inactive door.

2. Description of the Prior Art

A traditional system for locking up pairs of hinged doors in an entrance door frame is first to secure one of the doors, a normally inactive door, to the frame using a manually operated bolt. Subsequently, the other or normally active door is then lockingly engaged with the inactive door usually with a key operated lock. This system provides basic security, however, it does not provide the needed safety should a mishap such as fire or other panic situation occur within the building. Many building owners are likely to leave the inactive door in a locked or bolted condition during normal business hours, mainly for the purpose of traffic control or for reducing heating and cooling losses. In the event of a panic situation, people within the building cannot usually tell which door of the pair is locked or bolted and which is unlocked. Injuries may result from people trying to get out through a door that is bolted shut. Because of this problem, many codes have specifically proscribed the use of flush bolt locks on an inactive door in a pair of side-by-side entrance doors.

One attempted solution to this problem is provided by multiple point locks in which a single key is utilized to operate a locking system for securing a pair of doors to one another and at least one of the doors to the surrounding door frame when the lock is activated. Another expedient is to provide a bolt mechanism for the inactive door having a visual indicator to show whether it is locked or unlocked. The indicating bolt, however, does not assure that the door is unlocked, and often, such a bolt cannot be unlocked under a load as might be present in a panic situation.

Both of these prior art systems are unsatisfactory for a number of reasons. One reason is that after some usage, a pair of doors in a door frame are seldom perfectly aligned either with the surrounding entrance door frame or with one another and accordingly, a single key operated lock mechanism does not provide enough power or force to move the doors into proper alignment with one another and with the door frame so that the multiple bolts and strike plates may be properly lined up for locking.

OBJECTS OF THE PRESENT INVENTION

It is an object of the invention to provide a new and improved safety flush bolt entrance system which substantially eliminates the problems of prior art systems and which complies with most of the present day codes in force.

Yet another object of the present invention is to provide a new and improved safety type flush bolt entrance system wherein an inactive door may be lockingly secured to the entrance door frame and also lockingly secured to an adjacent active door of the entrance system.

It is another object of the invention to provide a safety flush bolt entrance system of the character described operable so that whenever an active door is unlocked one or more flush bolt mechanisms on an inactive door may be automatically disengaged from the door frame in response to force or thrust exerted to open the inactive door.

Another object of the present invention is to provide a new and improved safety flush bolt entrance door system of the character described wherein an inactive door is readily opened any time an active door adjacent thereto is in an unlocked condition.

Still another object of the present invention is to provide a new and improved safety flush bolt entrance door system wherein both doors of a pair of doors mounted in a door frame are normally utilized for traffic and swing freely between open and closed positions and yet a lock up of both doors may be accomplished by the operation of single lock mechanism to lock the doors together and at least one door to the door frame.

Still another object of the present invention is to provide a new and improved safety flush bolt entrance door system wherein one of the doors of a pair in an entrance frame is provided with a pair of safety flush bolts engageable to lock the door in a door frame and which are connected for activation by a common control unit.

Still another object of the present invention is to provide a new and improved safety flush bolt entrance system of the character described in the preceding paragraph wherein the other of the doors of the pair is provided with a lock mechanism adapted to interfere with the control unit so that in a locked condition the doors are secured to one another and at least one of the doors is also lockingly secured to the door frame.

Still another object of the present invention is to provide a new and improved safety flush bolt entrance system wherein a pair of operable doors are mounted in an entrance frame and at least one of the doors is securable to the frame when locked at a plurality of positions adjacent an outer or lock stile on at least one of the doors.

Still another object of the present invention is to provide a new and improved safety type flush bolt entrance system wherein a locking mechanism is provided on one of the doors for locking together the adjacent stiles of the doors and at the same time operable to prevent unlocking of one of the doors from interlocking engagement with the door frame.

Still another object of the present invention is to provide a new and improved safety flush bolt entrance system having a pair of hinged doors mounted in a frame and which provides excellent security, which is neat in appearance and which is safe in operation even in a panic situation.

SUMMARY OF THE INVENTION

The foregoing and other objects and advantages of the present invention are accomplished in a new and improved safety flush bolt entrance door system wherein a pair of doors are hingedly mounted for outward opening movement in a single door frame. A normally active door of the pair is provided with a lock mechanism adapted to lockingly engage an adjacent stile of the adjacent, normally inactive door for securing the two doors together in a locked condition. One or more flush bolt mechanisms is mounted on one normally inactive door for locking the door with the door frame whenever the locking mechanism of the active door is engaged to lock the doors together. A control unit is mounted on the normally inactive door and is interconnected with the flush bolt mechanism(s) so that whenever the pair of doors are unlocked from one another, the flush bolt mechanism(s) is releasable to unlock the inactive door with respect to the frame in response to an opening force or pressure applied on the door.

BRIEF DESCRIPTION OF THE DRAWINGS

For a better understanding of the present invention, reference should be had to the following detailed description taken in conjunction with the drawings, in which.

DESCRIPTION OF THE PREFERRED EMBODIMENTS

Figure 1:
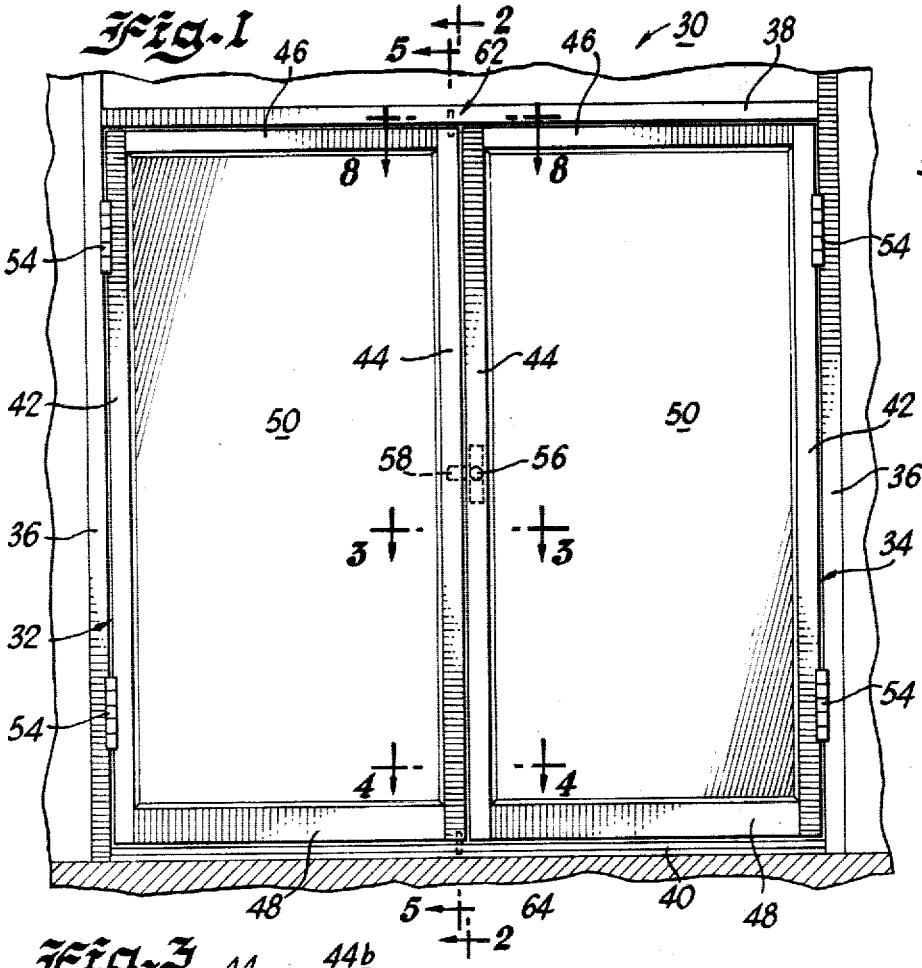
FIG. 1 is an outside or a front elevational view of a new and improved safety flush bolt entrance door system constructed in accordance with the features of the present invention.

Referring now more particularly to the drawings, FIGS. 1–11 illustrate one embodiment of a new and improved safety flush bolt entrance door system constructed in accordance with the features of the present invention and referred to generally by the reference numeral 30. The system includes a pair of swinging doors 32 and 34 mounted for outwardly opening movement in a door frame comprising a pair of vertical door jambs 36 interconnected by a horizontal header 38 above the doors and at the bottom by a threshold 40.

Each door includes a rectangular frame comprising an elongated, hollow tubular hinge stile 42 and a parallel, hollow tubular lock stile 44 of generally similar transverse cross-section. The vertical stiles are interconnected at upper and lower ends by a pair of upper and lower, horizontally extending rails 46 and 48 which form a large rectangular panel opening. A large rectangular panel such as a glazing panel 50 is secured around its peripheral edge within the opening of the door frame by a resilient, glazing strip gasket 52.

Figure 2:
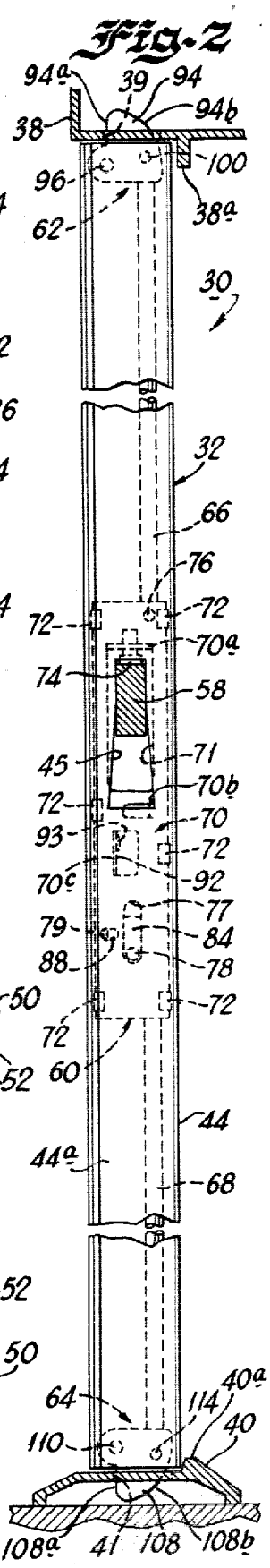
FIG. 2 is a vertical cross-sectional view taken substantially along lines 2—2 of FIG. 1.

The doors 32 and 34 are both mounted for outwardly opening, swinging movement and are supported on a plurality of hinges 54 secured to the hinge stile 42 of each door and the adjacent vertical door jamb 36. When both doors 32 and 34 are closed as shown in FIGS. 1 and 2, the inside faces of the doors are in a common plane closely adjacent a downwardly extending, integral stop element 38*a* formed on the upper, header 38. An upwardly projecting heel portion 40*a* is similarly provided on the threshold 40 to form a stop.

In many instances, the owner of a building will want to direct traffic through an entrance to move through only one of the pair of doors and in many prior art arrangements, this type of action usually resulted in one of the doors being inactivated by positively bolting or locking the door to the frame. As previously indicated, a safety hazard results, should a panic situation occur as no provisions are made in prior art arrangements for permitting a locked up or bolted, inactive door to be opened up in the event of a panic situation.

In the entrance system 30 of the present invention, a left-hand door 32 may be likened to an inactive door of the prior art in the sense that the other door 34 is used more, however, in accordance with the present invention, the door 32 may be readily opened by the application of opening pressure or thrust even though it is initially flush bolted to the door frame. In the event of a panic situation, pressure against the door 32 from persons inside the building will open the door automatically without unbolting and thereafter the door 32 will swing open and closed as an active door until it is again locked up.

Figure 5:
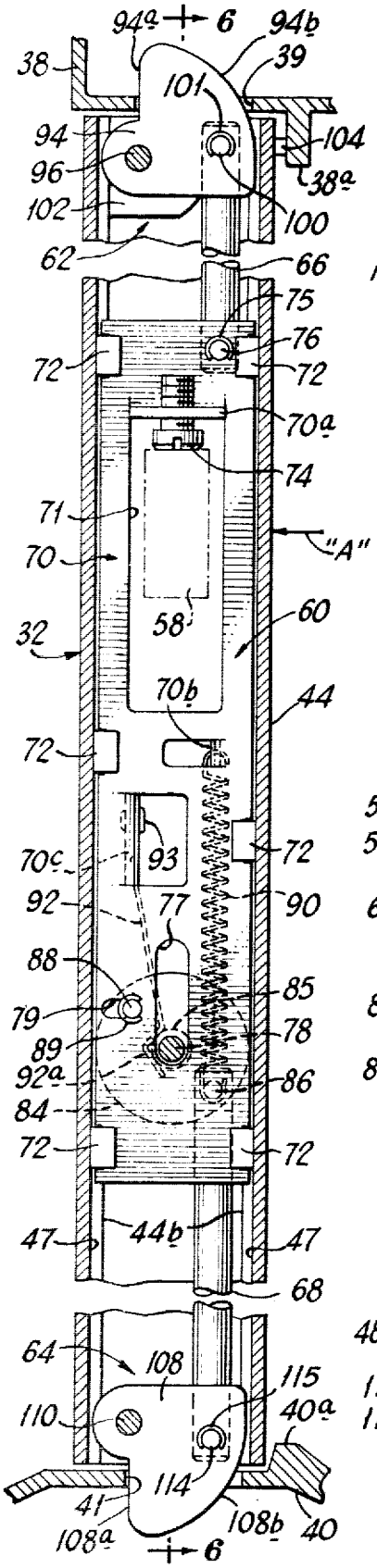
FIG. 5 is a vertical cross-sectional view taken substantially along lines 5—5 of FIG. 1.
Figure 6:
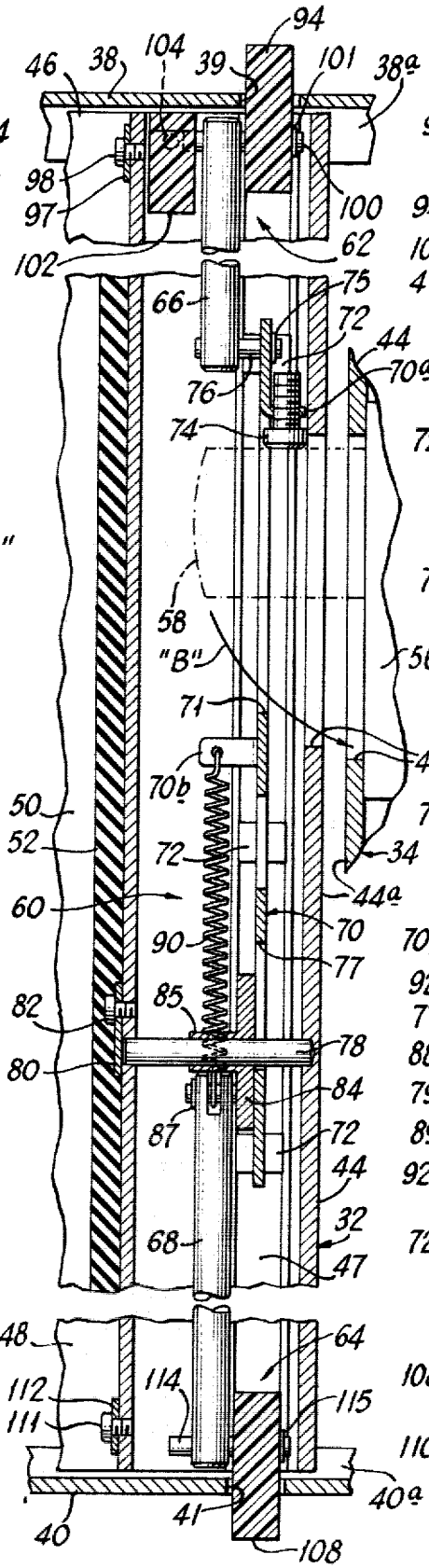
FIG. 6 is a vertical cross-sectional view taken substantially along lines 6—6 of FIG. 5.

The adjacent door 34 of the entrance may be considered a normally active door and in accordance with the invention, this door is equipped with a key operated lock mechanism 56 mounted on the lock stile 44 at an appropriate level as shown in FIG. 1. The lock 56 includes a bolt 58 which is key operated to pivot between a downward, vertically extended unlocked, position within the interior of the stile 44 to a generally horizontal outwardly extended, locked position (as shown in FIGS. 1, 5 and 6) in locking engagement with the stile 44 of the adjacent normally inactive door 32.

In order to accommodate the pivotable bolt 58, the adjacent and facing lock stile surfaces 44*a* of the doors 32 and 34 are formed with an elongated vertical slot 45 and these slots may be tapered to an increased width at the lower end portion (as shown in FIG. 2) so that when the lock bolt 58 is pivoted upwardly into the locking, horizontal position, the sloped edge surfaces of the slot in the inactive door stile helps to align the stiles 44 of the respective doors. When the bolt 58 is pivoted to the locking position, it is adapted to interact with a flush bolt control unit 60 (FIGS. 5, 6, 7 and 11) mounted in the interior of the lock stile 44 of the normally inactive door 32. The control unit is interconnected to operate a pair of upper and lower flush bolt mechanisms 62 and 64, by means of a pair of elongated, actuating rods 66 and 68 mounted within the hollow tubular door stile. The control unit 60, the upper and lower flush bolt mechanisms 62 and 64 and the interconnecting upper and lower activating rods 66 and 68 are preassembled together and the assembly is inserted longitudinally into the hollow interior of the lock stile from either end.

To aid during the insertion process and to provide operating guideways for normal operation of the control unit and flush bolt mechanisms, each stile 44 is provided with a pair of spaced apart, internal ribs 44*b* on opposite, facing interior surfaces of the inside and outside walls of the tubular stile. Each pair of spaced apart internal ribs 44*b* provides an elongated track or guideway 47 for supporting the control unit 60 and an upper and lower flush bolt mechanism 62 and 64 as will be described in more detail hereinafter.

Figure 7:
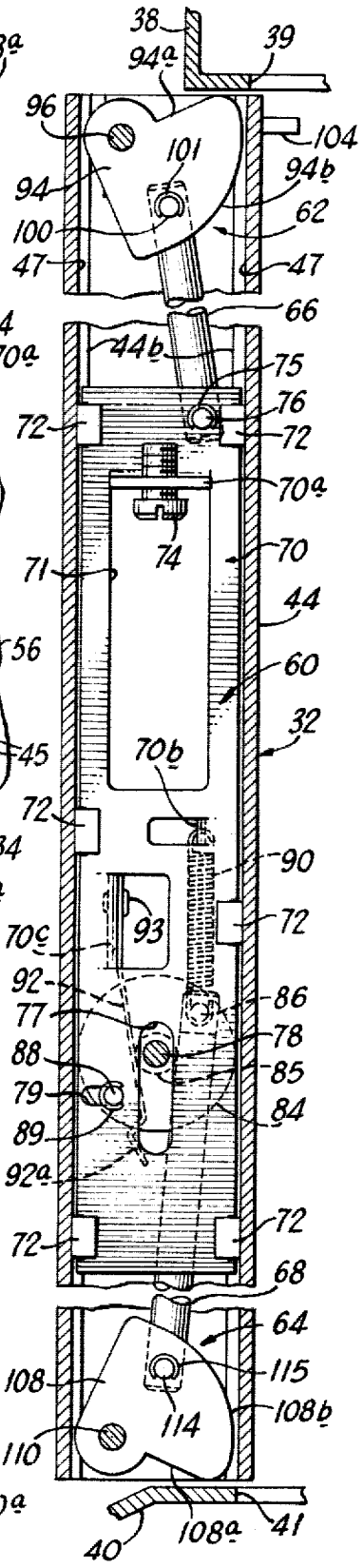
FIG. 7 is a vertical cross-sectional view similar to FIG. 5, but illustrating a control unit and flush bolt mechanisms of the present invention in a different operative position.

The control unit 60 includes an elongated, flat, metal slide plate 70 having a plurality of plastic guide blocks 72 secured in knocked out recesses provided along opposited edges and these blocks support the slide plate for smooth sliding vertical movement in the guideways 47 on opposite inside faces of the stile. The slide plate is movable between an upper or locking position (FIG. 5) and a lower or unlocked position as shown in FIG. 7, and in order to receive the pivotal bolt 58 of the lock 56 on the active door 34, the slide plate is formed with a relatively large, rectangular shaped opening 71 in the upper portion thereof. A right angle, horizontal tab 70*a* is struck from the body of the slide at the upper edge of the opening 71 and is formed with a threaded aperture to receive the shank of a headed cap screw 74 which serves as an adjustable stop to engage the upper edge of the pivotal lock bolt 58 when the bolt is in a locked position.

Figure 3:
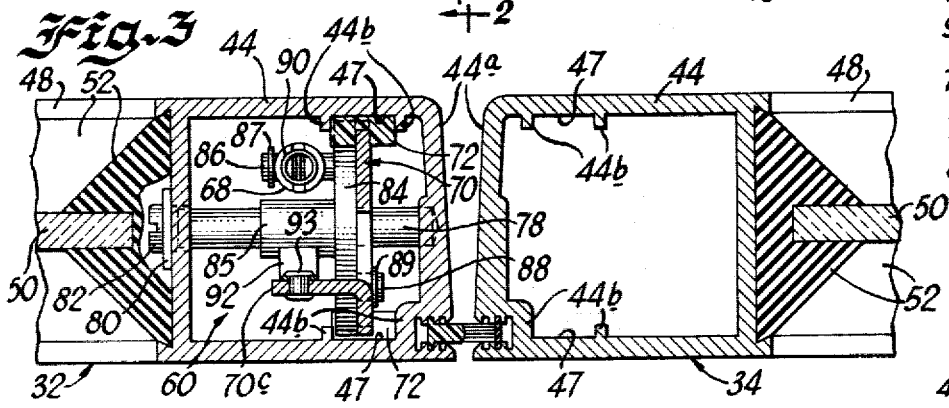
FIG. 3 is a fragmentary, horizontal cross-sectional view taken substantially along lines 3—3 of FIG. 1.

The upper end portion of the slide plate 70 is pivotally interconnected to the lower end of the upper control rod 66 by a cross-pin 76 which extends into an aperture 73 in the slide plate and a C-ring type retainer 75 is used to retain the cross-pin in place. Adjacent a lower portion, the slide plate 70 is formed with an elongated vertical slot 77 and a short, horizontal slot 79 adjacent a mid level thereof. A horizontal bearing pin or axle 78 is extended through the vertical slot 77 (as best shown in FIG. 6) and one end of the axle is supported in a circular recess formed in the inner surface of the stile face 44*a* with an opposite end of the axle supported in a drilled aperture in the opposite face of the stile. The axle is retained in position by a retaining plate 80 and cap screw 82 as best shown in FIGS. 3 and 6. The axle pin 78 provides support for a circular rotor 84 having an integral hollow axial bearing sleeve 85 journaled on the axle and the rotor is free to rotate around a horizontal axis extending transverse to the face 44*a* of the door stile.

The rotor is provided with a first eccentric pin 86 on one side of the central sleeve and the pin is pivotally connected to the upper end of the lower control rod 68 and is secured to prevent disengagement from the rod by a C-ring type retainer 87. The rotor includes a second eccentric pin 88 diametrically opposed on the opposite side of the central sleeve 85 and this pin extends in a opposite direction from the rotor and is adapted to project into the short, horizontal slot 79 of the slide plate 70. A C-ring retainer 89 is provided on the pin 88 to prevent disengagement of the pin from the slide plate 70.

In accordance with the present invention, the lower end of a main bias spring 90 is connected to the eccentric pin 86 and as shown in FIGS. 5 and 7, the spring tends to bias the rotor 84 in a counterclockwise direction about the axis of the eccentric pin 88 which is seated in the short, horizontal slot 89 of the slide plate. The upper end of the elongated coil spring 90 is secured to a tab 70*b* struck from the body of the slide plate and bent inwardly thereof as shown in FIG. 6. Tension exerted by the bias spring 90 tends to retract the lower control rod 68 upwardly to a released or unlocked position for unlocking the lower flush bolt mechanism 64 as will be described in more detail hereinafter.

In order to selectively overcome the bias of the main coil spring 90 so that both of the flush bolt mechanisms 62 and 64 may be secured and retained in a locked position as shown in FIGS. 5 and 6, the control unit 60 further includes a cantilevered type leaf spring 92 having an upper end secured to another tab 70*c* struck from the body of the slide plate 70 and bent inwardly at right angles thereto. At the upper end, the detent spring 92 is secured to the tab by a rivet 93 and includes a depending body terminating in a lower free end portion having a V-shaped detent or stop portion 92*a* for engaging the central sleeve 85 of the rotor 84 and thereby detaining the rotor sleeve in a position adjacent a lower end portion of the slot 77 of the slide plate against the bias force of spring 90. However, when sufficient relative upward force is exerted by the lower control rod 68 tending to aid the bias spring 90, the rotor 84 may be turned in a counterclockwise direction (FIGS. 5 and 7) as increased force is exerted by engagement of the eccentric pin 88 of the rotor against the lower surface of the slot 89 in the slide plate 70. As this occurs, the slide plate 70 moves downwardly relative to the axle pin 78 which is at a fixed elevation on the door stile 44. The force is sufficient to deflect the lower detent end portion 92*a* of the spring 92 outwardly and the main bias spring 90 is then effective to continue the relative rotation of the rotor 84 in a counterclockwise direction until reaching the unlocked position of FIG. 7. Thereafter, when the slide plate 70 is lifted from the unlocked position of FIG. 7 toward the locked position of FIGS. 5 and 6 for locking up the upper and lower flush bolt mechanisms 62 and 64, the lower end portion or detent 92*a* of the leaf spring 92 may seat against the bearing sleeve 85 of the rotor 80 to retain the mechanisms in the locked condition and retain the main bias spring 90 in an elongated or stretched condition as shown. The relative strengths of the main bias spring 90 and the detent spring 92 are chosen so that slide 70 is retained either in a locked position (FIGS. 5 and 6) or an unlocked position (FIG. 7) with a general or overall bias toward the locked position because of the greater effective strength of the main bias spring 90.

In accordance with the present invention, the upper flush bolt mechanism 62 includes a bolt element 94, preferably formed of hard, tough, molded plastic material and mounted for pivotal movement in the upper end of the hollow stile 44 on a pivot pin or axle 96 extending horizontally between a drilled recess on the inside face of the stile face 44*a* and an aperture on the opposite stile face. The pivot axle is secured in place by a plate 97 and cap screw 98 as shown in FIG. 6. The upper bolt includes a flat edge or locking surface 94*a* extending radially outwardly of the pivot axle and an arcuate edge surface 94*b*, which surfaces defines a locking bolt portion adapted to project into an opening 39 formed in the header 38 of the door frame whenever the bolt is in a locked position as shown in FIGS. 5 and 6. When outward opening pressure is exerted on the door as indicated by the arrow "A" in FIG. 5, the flat edge 94*a* of the bolt engages an adjacent edge of the slot 39 and this engagement tends to pivot the bolt 94 in a clockwise direction toward the unlocked position as shown in FIG. 7.

Figure 8:
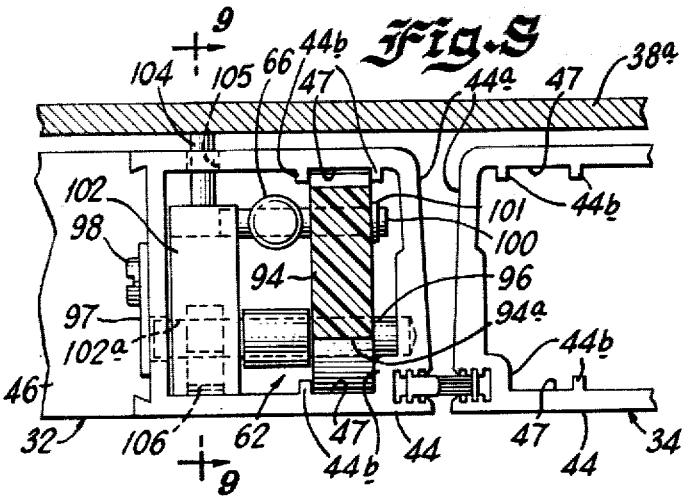
FIG. 8 is a fragmentary, horizontal cross-sectional view taken substantially along lines 8—8 of FIG. 1.
Figure 9:
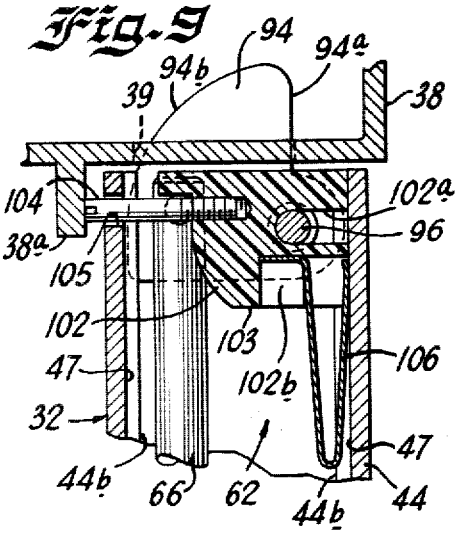
FIG. 9 is a fragmentary, vertical cross-sectional view taken substantially along lines 9—9 of FIG. 8.
Figure 10:
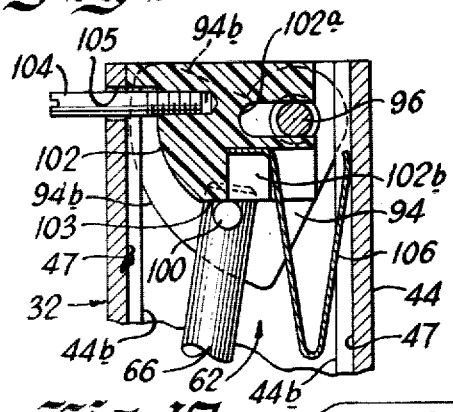
FIG. 10 is a fragmentary, vertical cross-sectional view similar to FIG. 9 but showing a flush bolt mechanism in an unlatched position.
Figure 12:
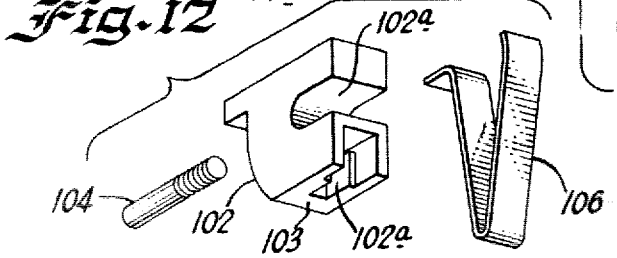
FIG. 12 is an exploded perspective view of an upper flush bolt mechanism in accordance with the present invention.
Figure 11:
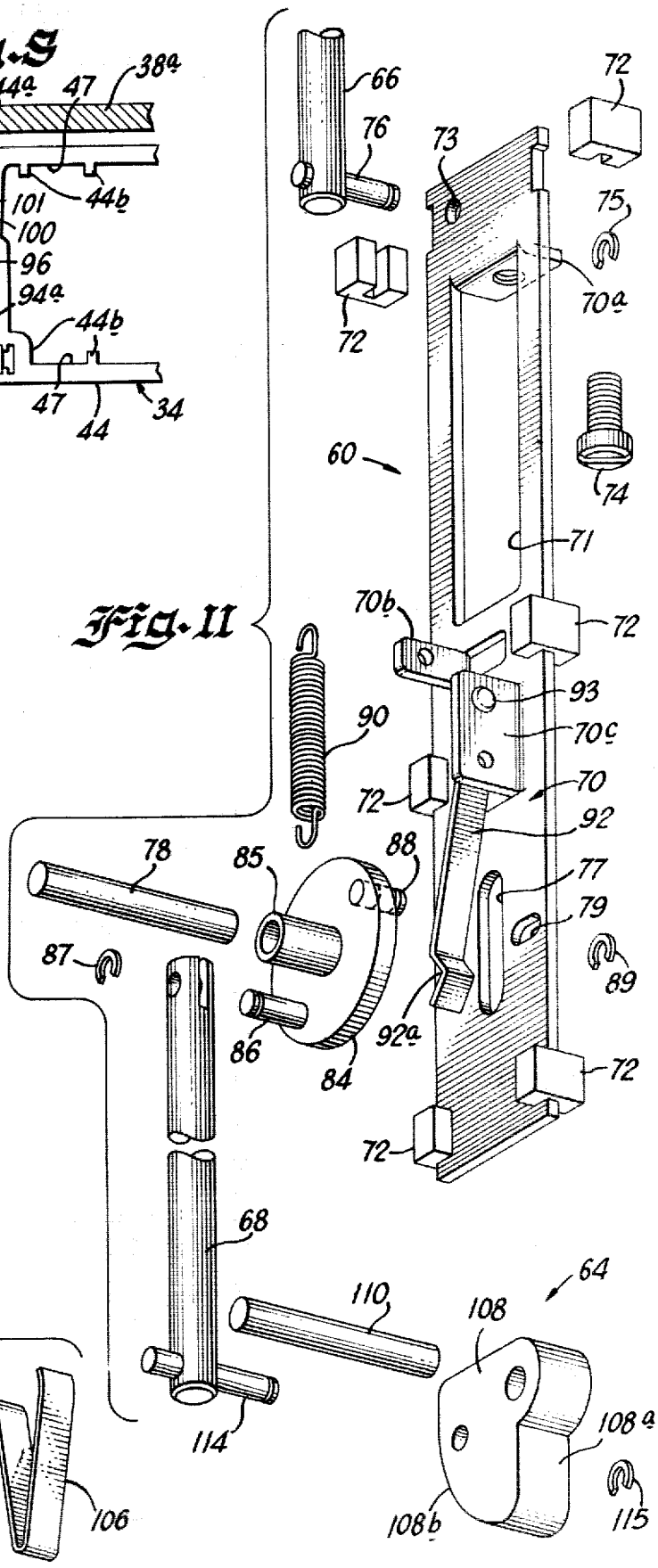
FIG. 11 is an exploded, perspective view of the control unit and a lower flush bolt mechanism in accordance with the present invention.

A lower body portion of the bolt 94 is pivotally interconnected to the upper end of the upper control rod 66 by a cross-pin 100 eccentric and parallel of the pivot axle 96 and a C-ring 101 is used to prevent disengagement of the cross-pin and the bolt. Whenever the bolt 94 is pivoted to the unlocked position as shown in FIG. 7 and the door is opened, the bolt is normally retained in the unlocked position so that later upon closing of the door, the bolt will not interfere or strike with the outer edge of the header 38 of the door frame to prevent full closing of the door. In order to retain the bolt in the unlocked position whenever the door is opened, the upper flush bolt mechanism 62 is provided with a retaining element 102 preferably formed of molded plastic material and mounted for horizontal sliding movement between inside and outside faces of the door stile 44 as shown in FIGS. 9 and 10. The retainer 102 is supported for horizontal movement on the axle pin 96 and is formed with a horizontal slot 102*a* for receiving the axle pin. An adjustable stop pin 104 is provided to support the retainer 102 and the stop pin is threaded into an aperture on an inside edge of the retainer. The stop pin extends outwardly through an opening 105 formed in the inside wall of the stile 44 and normally engages with the header stop 38*a* whenever the door is closed as shown in FIGS. 8 and 9. The outer end of the stop pin 104 is formed with a slot for a screwdriver to permit relative adjustment of the stop pin on the retainer 102 to provide the desired stop action. As shown in FIG. 9, when the door 32 is in a closed position, an outer end of the stop pin 104 engages the header stop 38*a* and biases the retainer 102 toward right (FIG. 9) and in this position, the blind end of the slot 102*a* of the retainer is seated against the axle pin 96. When the door is opened, the retainer 102 moves horizontally towards the left or inside face of the door stile 44 (FIG. 10) and this movement is attained by a generally V-shaped bias spring 106 having the upper end of one leg engaged against the inside surface of the outer face of the door stile and an opposite leg having a horizontal segment seated in a slot 102*b* formed on the underside of the retainer. The horizontal segment of the bias spring 106 is positively secured within the slot 102*b* so that the spring does not drop out.

Whenever the upper bolt 94 is pivoted from the locked position of FIGS. 5 and 6 to the unlocked position of FIG. 7, the cross-pin 100 which connects the upper control rod 66 to the bolt moves downwardly and reaches a level below an underside 103 of the retainer 102. This flat generally horizontal undersurface 103 provides a stop surface to prevent upward movement of the cross-pin and control rod 66 from the unlocked position of FIG. 10 towards the locked position of FIG 9. Accordingly, the bolt 94 is positively retained in the unlocked position until such time as the door is closed. When the door is closed, the preventer is moved to the position of FIG. 9 by engagement of the stop pin 104 against the header stop 38*a* and, when this occurs, the stop surface 103 of the preventer moves out of the way of the cross-pin 100 at the upper end of the control rod 66 and the rod is then free to move upwardly to lock the bolt 94. Upward movement of the rod 66 in turn elevates the slide plate 70 of the control unit 60 and this results in movement of the rotor 84 in a counterclockwise direction from the position of FIG. 7 toward the position of FIG. 5.

It will thus be seen that the upper flush bolt mechanism 62 includes a pivotal bolt 94 which is movable between a locked position extending upwardly into the slot 39 of the header 38 (FIGS. 5 and 9) and an unlocked position (FIGS. 7 and 10) out of engagement with the header. Whenever the bolt is in the unlocked position and the door is opened, the bolt is positively retained in an unlocked position by the underside or stop surface 103 of the retainer which prevents upward travel of the pin 100 and upper control rod 66. This restraint in turn, retains the slide plate 70 of the control unit 60 in the lower or unlocked position of FIG. 7.

Figure 4:
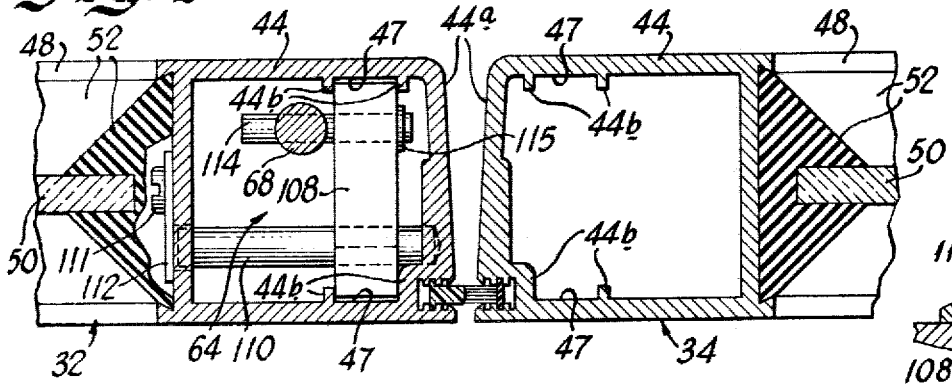
FIG. 4 is a fragmentary, horizontal cross-sectional view taken substantially along lines 4—4 of FIG. 1.

The lower flush bolt mechanism 64 includes a pivotal bolt 108 substantially similar or identical in shape to the upper bolt 94 and preferably formed of hard, tough, molded plastic material. The lower bolt is mounted for pivotal movement on an axle 110 extending between a circular recess formed on the inside surface of the stile face 44*a* and a circular aperture provided in the opposite face. The axle pin is contained within the stile by a stop plate 112 and cap screw 111 (FIG. 4). The bolt 108 is pivotally supported on the axle 110 for movement between a downwardly extending, locking position as shown in FIGS. 5 and 6 and an upper, unlocked position as shown in FIG. 7 wherein the entire bolt is contained within the hollow interior at the lower end of the door stile 44. The threshold 40 of the door frame is formed with a rectangular slot 41 to receive the bolt in a locking position and a radial edge 108*a* of the bolt is adapted to engage an edge of the slot for locking the door or pivoting the bolt in a counterclockwise direction from the position of FIG. 5 to the unlocked position of FIG. 7 when the door is unlocked and opened. The lower end of the lower control rod 68 is pivotally interconnected with the lower bolt 108 by means of a crosspin 114 extending through an eccentric aperture in the bolt and a C-ring 115 is utilized to maintain the connection between the control rod and the bolt.

As previously indicated, when the door is unlocked and opening pressure or thrust is applied on the door tending to swing it open (as indicated by the arrow "A" in FIG. 5), the respective bolt surfaces 94*a* and 108*a* engage the adjacent edges of the slots 39 and 41 in the respective header or transom 38 and threshold 40 of the door frame and this tends to pivot the upper bolt in a clockwise direction (FIG. 5) to move the bolts towards the unlocked position of FIG. 7. The force exerted on the door is transmitted via the bolts 94 and 108 through the control rods 66 and 68 to the slide plate 70 and is sufficient to overcome the holding detent force of the cantilever spring 92 on the rotor sleeve 85. When this occurs, the main bias spring 90 helps to cause the rotor 84 to turn in a counterclockwise direction as the slide plate descends from the position of FIG. 5 to the position of FIG. 7.

As previously indicated, the retainer 102 maintains the upper bolt 94 in a locked condition until the door is fully closed and the interconnecting linkage of the upper and lower bolts, the respective control rods 66 and 64 and the control unit 60 retains the lower bolt 108 in an upwardly pivoted unlocked position of FIG. 7 until such time as the door is again closed and the retainer 102 moved out of a stopping position so that the upper bolt 99 may again be locked. If the door 32 is closed, the upper and lower bolts 94 and 108 will remain in the unlocked condition as shown in FIG. 7 until such time as the slide plate 70 of the control unit 60 is moved upwardly to again lock the bolts. During this locking process, the main bias spring 90 is stretched under tension until the slide plate 70 moves far enough upward so that the retaining spring detent **92*a* engages and holds the bearing sleeve 85 of the rotor 84. This engagement then retains the bolts in the locked position with the slide plate 70 in the upper locked position along with the horizontal lock bolt 58. When the lock bolt 58 of the lock 56 on the active door 32 is subsequently unlocked resulting in a downward pivotal movement as indicated by the arrow "B" in FIG. 6, the inactive door 32 will continue to remain in a locked condition with the frame until such time as a sufficient opening force (Arrow "A") is applied thereto to cause the respective upper and lower flush bolt assemblies 62 and 64** to automatically unlock and permit the door to swing freely outwardly into the open position.

Should a panic situation occur in a building, when the active door 34 has been unlocked, pressure tending to open the inactive door 32 will automatically unlock the upper and lower bolts 94 and 108 and permit the door to swing freely open so that people may move out rapidly through the entrance.

This process is automatic and no other unlatching or unbolting function is required. Once the upper and lower bolts 94 and 108 have been unlocked as described, they are normally maintained in the unlocked condition by the retainer 102 until the door 32 is closed and after the door is closed, the detent spring 92 normally maintains this condition so that the door 32 may then serve as an active door to swing freely open and closed.

At the end of the day when it is desired to close and lock up both of the doors 32 and 34, the normally inactive door 32 is first closed and the upper and lower flush bolt mechanisms 62 and 64 are normally locked up by insertion of the finger or other implement into the interior of the door stile 44 through the openings 45 and 71 and pushing the slide plate 70 upwardly until the detent **92*a* of the detent spring engages the rotor sleeve 85. The bolts 94 and 108 can only be locked up in this manner, however, if the door is in a closed condition and the stop pin 104 has moved the stop surface 103 of the retainer 102 out of the way so that the upper bolt 94 is lockable. Once the door is locked up in this manner, the lock 56 on the active door 34 may be key operated to pivot the lock bolt 58** into the horizontal position.

The pair of doors 32 and 34 are thus locked to each other and one of the doors (the normally inactive door 32) is also locked to the header 38 and the threshold 40 of the door frame at the lock stile 44. The entrance system of the present invention thus provides a safe and secure arrangement and also complies with most building codes, yet permits some control of the traffic through the entrance 30 into and out of the building.

Referring now to FIGS. 13–20 of the drawings, therein is illustrated another embodiment of a new and improved safety flush bolt entrance door system referred to by the numeral 130 and constructed in accordance with the features of the present invention. Identical reference numerals will be utilized for components in the latter embodiment which are similar to or identical with components in the prior embodiment previously described herein and only the differences in the two embodiments will be described in detail.

Figure 14:
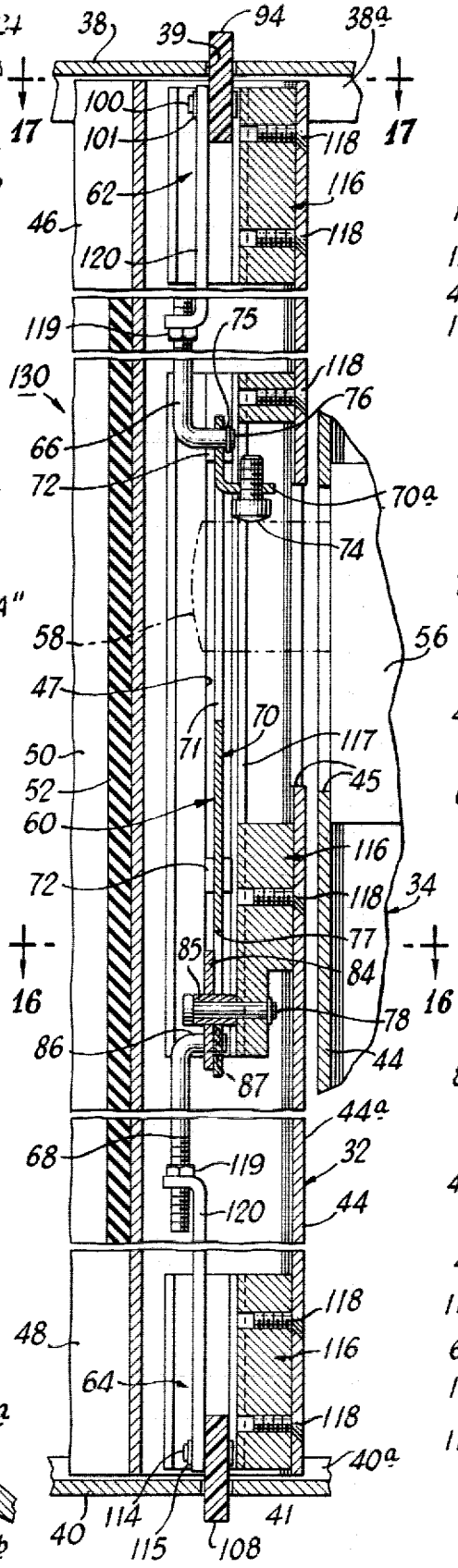
FIG. 14 is a vertical cross-sectional view taken substantially along lines 14—14 of FIG. 13.
Figures 16, 17, 18, 19, 20:
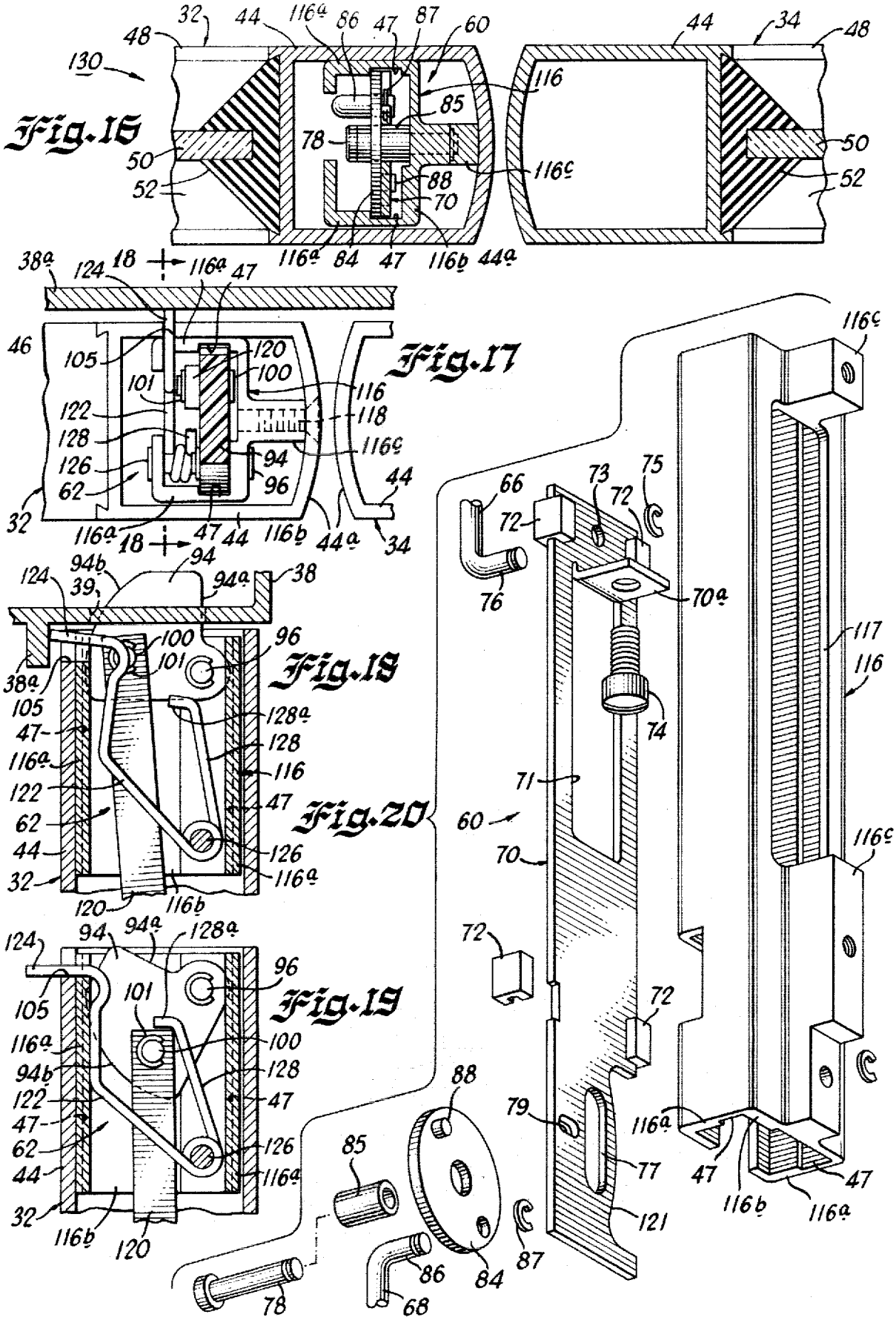
FIG. 16 is a fragmentary, horizontal cross-sectional view taken substantially along lines 16—16 of FIG. 14.
FIG. 17 is a fragmentary, horizontal cross-sectional view taken substantially along lines 17—17 of FIG. 14.
FIG. 18 is a fragmentary, vertical cross-sectional view taken substantially along lines 18—18 of FIG. 17.
FIG. 19 is a fragmentary, vertical cross-sectional view similar to FIG. 18, but illustrating an upper flush bolt mechanism in an unlocked condition when the door is opened.
FIG. 20 is a fragmentary, exploded perspective view of a control unit for the safety flush bolt entrance system of the embodiment of FIGS. 13 through 19.

The entrance door system 130 is adapted to be used with conventional type of doors 32 and 34 having lock stiles 44 without internal ribs **44*b* or the like defining guideways for the control and flush bolt mechanisms in the prior embodiment. As illustrated in FIGS. 16 and 17, the control unit 60, upper flush bolt assembly 62 and lower flush bolt assembly 64 are adapted to be mounted on independent chassis members 116*b* and these members have a cross-section as shown with a large, generally channel-shaped recess defined by a pair of opposite sidewalls 116*a* (FIG. 16) having recesses or grooves therein defining guideways 47 for the operating parts. The chassis or bases for each control and flush bolt mechanism are identical and are formed from an elongated aluminum extrusion which includes a base wall 116*b* integrally joined with the sidewalls 116*a* and a mounting rib 116*c* is integrally formed on the base wall 116*b* to project outwardly away towards the inside surface of the curved stile faces 44*a* for securing the bases in place at the desired level on a stile with threaded cap screws 118 as best shown in FIG. 14. The chassis or base 116 for the control unit 60 and the upper and lower flush bolt mechanism 62 and 64 are fixedly secured to the stile 44 of the door 32 with cap screws 118 threaded into the rib 116*c*. The flush bolt mechanisms 62 and 64 and the control unit 60 are operably interconnected by respective upper and lower control rods 66 and 68 having L-shaped brackets 120 pivotally interconnected to the respective pivot bolts 94 and 108 and adjustably secured onto threaded ends of the control rods and held in place with lock nuts 119**.

Figure 13:
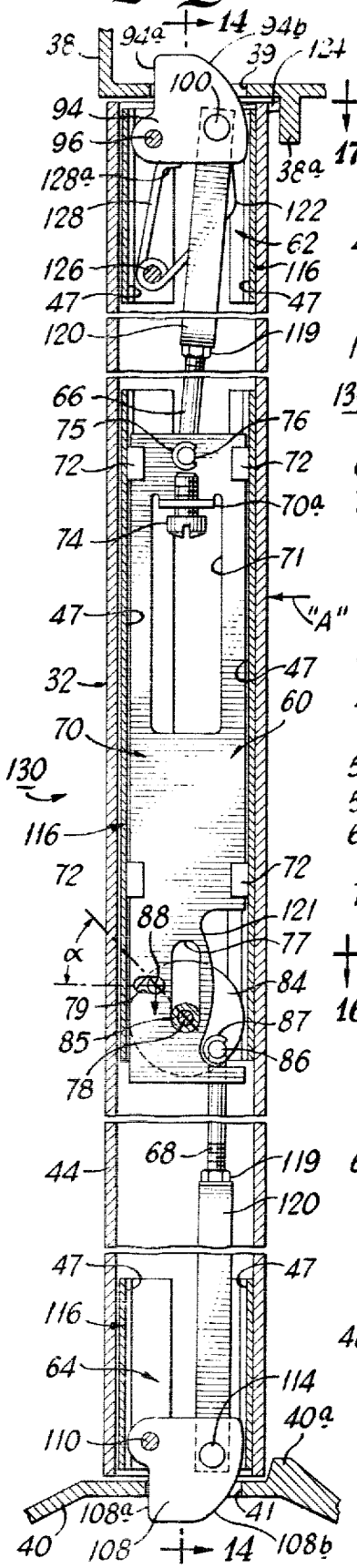
FIG. 13 is a vertical cross-sectional view similar to FIG. 5 but illustrating another embodiment of safety flush bolt entrance system constructed in accordance with the features of the present invention.
Figure 15:
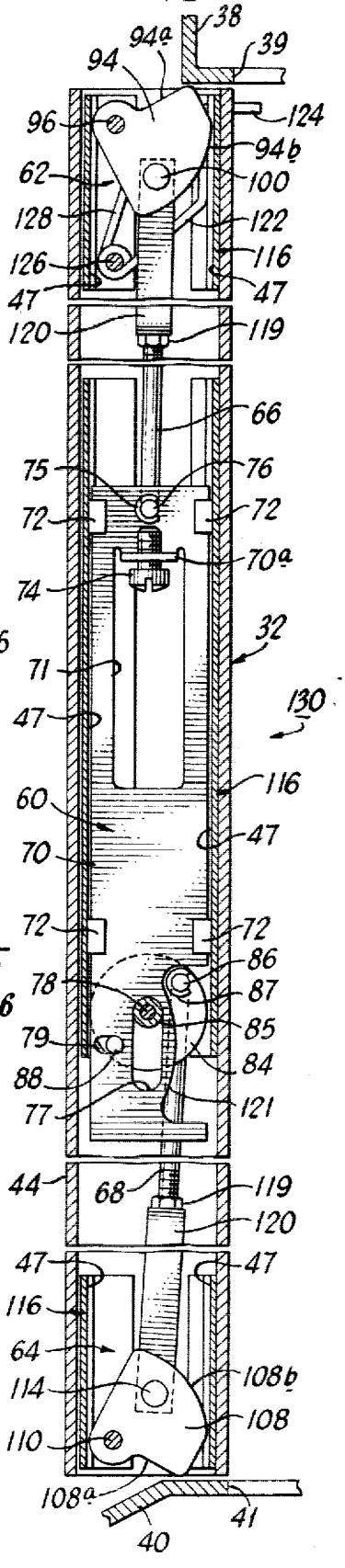
FIG. 15 is a vertical cross-sectional view similar to FIG. 13 but showing flush bolt mechanisms and a control unit interconnected therewith in a different operative position.

Referring to FIG. 20, the control unit 60 is somewhat different than that of the prior embodiment in that an elongated slide plate 70 is mounted for sliding vertical movement in guideways 47 defined in the chassis or base 116. The chassis is formed with a large rectangular slot or opening 117 in the base wall portion **116*b* for receiving the lock bolt 58 on the active door 34. The control unit 60 of FIG. 20 does not include a main bias spring 90 or a detent spring 92 as in the prior embodiment and instead utilizes frictional forces exerted between the eccentric pin 88 on the rotor disc 84 and the adjacent horizontal wall surfaces of the short slot 77 in the slide plate for maintaining the control unit 60 in either a locked position as shown in FIGS. 13 and 14 or an unlocked lower position as shown in FIG. 15**. The control unit and flush bolt mechanisms provide an automatic bistable system without requiring bias springs as in the prior embodiment.

The upper flush bolt mechanism 62 and the interconnecting control rod 66 and bracket 120 is slightly heavier than the lower flush bolt mechanism 64 and the interconnecting control rod 68 and bracket 120 so that a slight downward bias toward the unlocked position is applied to the control unit 60 and this bias normally tends to move the slide plate 70 downwardly from the locked position of FIGS. 13 and 14 into the unlocked position of FIG. 15. The downward bias force is overcome, however, when the system is locked by the frictional or metal to metal force exerted between the rotor pin 88 and the horizontal surfaces of the short horizontal slot 79 in the slide plate 70. When the system is locked, an angle "α" between the horizontal slot 79 and a line extending between the eccentric pin 88 and the central rotor support pin 78 is great enough so that metal to metal forces between the pin and slot surfaces is sufficient to retain the upper and lower flush bolt mechanisms 62 and 64 in the locked condition even though the door may be subjected to considerable amounts of vibration. This holding force may be overcome however, by an opening force applied against the door 32 as indicated by the arrow "A" in FIG. 13, which force tends to rotate or cam the respective upper and lower bolts 94 and 108 to an unlocked position because of the forceful contact between the surfaces 94*a* and 108*a* and the edges of the slots 34 and 41 in the header 38 and threshold 40. This force is sufficient to overcome the metal to metal frictional holding force between eccentric pin 88 and the surfaces of the short horizontal slot 79 in the slide plate 70. When an opening force is thus exerted against the door (arrow "A"), the rotor 84 begins to rotate in a counterclockwise direction and the angle "α" (FIG. 13) begins to decrease. As the angle decreases, the downward bias acts with a greater moment arm on the rotor 84 and this increasing torque is enough to unlock the lower flush bolt mechanism 64 and retract the lower control rod 68 upwardly until the lower bolt 108 is pivoted completely into the unlocked position.

As this retraction occurs, a cross-pin portion 86 at the upper end of the lower control rod 68 which is connected to the rotor 84 moves upwardly from a lower stop position adjacent the lower end of an edge slot 121 in the slide 70 to an upper stop position adjacent an upper end of the slot as shown in FIG. 15. In the latter stop position, the pivotable bolts 94 and 108 are both retracted into the stile 44 and remain in the unlocked condition until the door is again locked up. The control mechanism 60 and the associated, interconnected upper and lower flush bolt mechanisms 62 and 64 forms a bistable system wherein the upper and lower flush bolts 94 and 108 are either in a locked condition with the slide plate 70 in an upper position or in an unlocked condition with the slide plate in a lower position as illustrated.

Referring to FIGS. 17–19, a modified upper flush bolt mechanism 62 uses a single, wire-formed retainer element 122 for maintaining the upper bolt 94 in an unlocked position whenever the door 32 is open and away from the header stop 38*a* as shown in FIG. 19. The element 122 is formed of spring wire and includes a horizontal upper, stop finger 124 having an outer end adapted to contact the stop surface 38*a* of the header 38 when the door is closed as shown. At the lower end, a coil of the retainer 122 is supported on a mounting pin 126 carried in the chassis 116 of the upper flush bolt mechanism 62. The retainer includes an upstanding stop finger 128 having a short horizontal stop 128*a* at the upper end for positively restraining further upward travel of an upper end of the bracket 120 on the upper control rod 66, thereby to prevent pivotal movement of the bolt lock 94 from an unlocked position of FIG. 19 back into the locked position of FIG. 18 unless and until the door is closed with the top finger 124 again engaging the header stop 38*a*.

The single element retainer 122 functions similar to the retainer 102, stop pin 104 and bias spring 106 of the prior embodiment. As in the prior embodiment, whenever the door is open, the retainer element 122 functions to retain the upper and lower pivotable bolts 94 and 108 in the unlocked condition so that the bolts do not interfere with subsequent swinging movement or closing of the door. The modified form of safety flush bolt entrance door system 130 shown in FIGS. 13–20 of the drawings is somewhat simplified in mechanical terms with respect to the embodiment of FIGS. 1–11 but, essentially functions in a similar manner and provides the new and unique results as described.

Although the present invention has been described with several illustrated embodiments thereof, it should be understood that numerous other modifications and embodiments can be devised by those skilled in the art that will fall within the spirit and scope of the principles of this invention.

What is claimed as new and desired to be secured by Letters Patent of the United States is:

1. A door mounted for movement between open and closed positions with respect to a door frame, comprising:

latch means on said door movable between a latched position engaging said frame for securing said door in said closed position and an unlatched position disengaged from said frame permitting movement of said door toward said open position; and control means remote from said latch means for controlling the same to prevent disengagement from said frame in response to opening force applied to said door when said control means is in a first condition and to permit said latch means to move to said unlatched position, disengaged from said frame in response to opening force applied to said door when said control means is in a second condition, said control means including means normally biasing said latch means toward said unlatched position.

2. The door of claim 1 including means responsive to the position of said door with respect to said frame for maintaining said latch means in said unlatched position when said door is in an open position.

3. The door of claim 2 wherein said door position responsive means for maintaining said latch means in said latched position when said door is in an open position is movable to a first position permitting said latch means to move into said latched position when said door is in a closed position.

4. The door of claim 3 wherein said door position responsive means is normally biased toward a second position for preventing said latch means from moving into said latched position.

5. The door of claim 1 including a plurality of said latch means spaced apart for engagement with different portions of said door frame when in said latched position.

6. The door of claim 5 wherein said control means is interconnected with said plurality of latch means for moving one of said latch means from the latched to the unlatched position as a result of movement of the other of said latch means to the unlatched position in response to opening force applied to said door.

7. The door of claim 5 including a door stile supporting said control means and said latch means at one end thereof, and a second latch means at an opposite end of said stile.

8. The door of claim 7 wherein said stile is hollow and said control means and said latch means are mounted internally thereof with said control means spaced between the ends of said stile.

9. The door of claim 8 including elongated link members extended longitudinally and mounted internally of said hollow stile for interconnecting said control means and said latch means at opposite end of said stile.

10. The door of claim 9 wherein said link members are movable toward said control means when said latch means at opposite ends of said stile are unlatched from said door frame.

11. The door of claim 10 wherein said control means includes a slider mounted to slide in said hollow stile and interconnected with said link members to be movable in one direction when said pair of latch means move from an unlatched position toward said latched position and movable in an opposite direction when said pair of latch means move from said latched position toward said unlatched position.

12. The door of claim 1 wherein said door includes a hollow lock stile and said control means includes a control element mounted inside said hollow stile movable between said first and second conditions.

13. The door of claim 12 wherein said stile includes an access opening adjacent said control element for permitting means insertable through said access opening to move said element toward said second condition for engaging said latch means with said door frame when said door is in a closed position.

14. The door of claim 12 wherein said hollow lock stile includes means on internal surfaces thereof forming a guideway for sliding movement of said control element.

15. The door of claim 14 wherein said latch means includes a movable bolt having a portion disposed for guidance in said guideway during movement of said bolt between said latched and said unlatched positions.

16. The door of claim 1 wherein said control means is operable to move from said second condition to said first condition when said door is in a closed position in said door frame.

17. The door of claim 16 wherein said door includes a hollow door stile forming a housing for said control means and including an access opening for permitting movement of said control means into said first condition by means applied externally of said door.

18. A pair of first and second doors mounted for movement between open and closed positions with respect to a door frame, said doors having lock stiles in closely adjacent positions when said doors are in a closed position, comprising:

latch means on said first door movable between a latched position engaging said frame for securing said first door in said closed position and an unlatched position disengaged from said frame permitting movement of said first door toward said open position;

control means remote from said latch means for controlling the same to prevent disengagement from said frame in response to opening force applied to said first door when said control means is in a first condition and to permit said latch means to move to said unlatched position, disengaged from said frame in response to opening force applied to said first door when said control means is in a second condition, and said control means including a manually operated element on said second door movable toward and away from said first door between a locking position for preventing said latch means from moving to said unlatched position when said doors are closed and an unlocked position permitting said latch means to move toward said unlatched position for opening at least one of said doors.

19. The door combination of claim 18 wherein said control means includes means normally biasing said latch means toward said unlatched position.

20. The door combination of claim 18 wherein said control means includes a control element on said first door operatively interconnected with said latch means and movable between said first and second conditions, said manually operated element engaging said control element when the former is in said locking position and the latter is in said first condition when said doors are closed.

21. The door combination of claim 20 wherein said control element is mounted on said first door in position for external access and manual operation independent of said manually operated element of said second door.

22. The door combination of claim 21 wherein said stile of said first door is formed with an access opening facing said second door when said doors are closed for receiving said manually operated element of said second door when moved to said locking position engaging said manually operated element of said first door.

23. The door combination of claim 22 wherein said recess opening is dimensioned to permit operation of said element by manual means inserted through said opening when said second door stile is positioned away from said facing adjacent closed position with respect to said stile of said first door.

24. The door combination of claim 22 wherein said control element includes operating means thereon accessible externally of said stile through said access opening for permitting movement of said control element into said locking position.

25. The door combination of claim 24 wherein said operating means includes an opening in said control element for receiving means for implementing said movement.

26. The door combination of claim 18 including means responsive to the position of said first door with respect to said frame for maintaining said latch means in said unlatched position when said first door is in an open position.

27. The door combination of claim 26 wherein said door position responsive means for maintaining said latch means in said latched position when said first door is in an open position is movable to a first position permitting said latch means to move into said latched position when said first door is in a closed position.

28. The door combination of claim 27 wherein said door position responsive means is normally biased toward a second position for preventing said latch means from moving into said latched position.

29. The door combination of claim 18 including a plurality of said latch means spaced apart for engagement with different portions of said door frame when in said latched position.

30. The door combination of claim 29 wherein said control means is interconnected with said plurality of latch means for moving one of said latch means from the latched to the unlatched position as a result of movement of the other of said latch means to the unlatched position in response to opening force applied to said first door.

31. The door combination of claim 29 including a door stile supporting said control means and said latch means at one end thereof, and a second latch means at an opposite end of said stile.

32. The door combination of claim 31 wherein said stile is hollow and said control means and said latch means are mounted internally thereof with said control means spaced between the ends of said stile.

33. The door combination of claim 32 including elongated link members extended longitudinally and mounted internally of said hollow stile for interconnecting said control means and said latch means at opposite ends of said stile.

34. The door combination of claim 33 wherein said link members are movable toward said control means when said latch means at opposite ends of said stile are unlatched from said door frame.

35. The door combination of claim 34 wherein said control means includes a slider mounted to slide in said hollow stile and interconnected with said link members to be movable in one direction when said pair of latch means move from an unlatched position toward said latched position and movable in an opposite direction when said pair of latch means move from said latched position toward said unlatched position.

36. The door combination of claim 18 wherein said first door includes a hollow lock stile and said control means includes a control element mounted inside said hollow stile movable between said first and second conditions.

37. The door combination of claim 36 wherein said stile includes an access opening adjacent said control element for permitting means insertable through said access opening to move said element toward said second condition for engaging said latch means with said door frame when said first door is in a closed position.

38. The door combination of claim 36 wherein said hollow lock stile includes means on internal surfaces thereof forming a guideway for sliding movement of said control element.

39. The door combination of claim 38 wherein said latch means includes a movable bolt having a portion disposed for guidance in said guideway during movement of said bolt between said latched and said unlatched positions.

40. The door combination of claim 18 wherein said control means is operable to move from said second condition to said first condition when said first door is in a closed position in said door frame.

41. The door combination of claim 40 wherein said first door includes a hollow door stile forming a housing for said control means and including an access opening for permitting movement of said control means into said first condition by means applied externally of said first door.

* * * * *